United States Patent [19]

Buisson

[11] Patent Number: 4,982,713

[45] Date of Patent: Jan. 8, 1991

[54] UNIT FUEL INJECTOR INCLUDING A FUEL INJECTION PUMP FOR INTERNAL COMBUSTION ENGINES

[75] Inventor: Dominique Buisson, Venissieux, France

[73] Assignee: Robert Bosch GmbH, Stuttgart, Fed. Rep. of Germany

[21] Appl. No.: 542,136

[22] Filed: Jun. 22, 1990

[30] Foreign Application Priority Data

Jul. 20, 1989 [DE] Fed. Rep. of Germany ..... 3924127

[51] Int. Cl.[5] ..... F02M 41/00

[52] U.S. Cl. ..... 123/467; 123/198 D

[58] Field of Search ..... 123/467, 445, 446, 447, 123/198 D, 198 DB, 503, 458

[56] References Cited

U.S. PATENT DOCUMENTS

| | | | |
|---|---|---|---|
| 4,171,099 | 10/1979 | Kopse | 123/446 |
| 4,545,352 | 10/1985 | Jourde | 123/458 |
| 4,566,416 | 1/1986 | Berchtold | 123/458 |
| 4,603,671 | 8/1986 | Yoshinaga | 123/467 |
| 4,637,351 | 1/1987 | Pakula | 123/25 J |
| 4,640,252 | 2/1987 | Nakamura | 123/446 |
| 4,665,881 | 5/1987 | Wade | 123/467 |
| 4,669,429 | 6/1987 | Nishida | 123/447 |
| 4,669,659 | 6/1987 | Leblanc et al. | 239/91 |
| 4,719,889 | 1/1988 | Amann | 123/447 |
| 4,784,101 | 11/1988 | Iwanaga | 123/467 |
| 4,909,440 | 3/1990 | Mitsuyasu | 123/467 |

FOREIGN PATENT DOCUMENTS 2312860 3/1973 Fed. Rep. of Germany .

*Primary Examiner*—Carl Stuart Miller

*Attorney, Agent, or Firm*—Edwin E. Greigg

[57] ABSTRACT

A fuel injection pump including a pump piston, which pumps fuel at injection pressure to an injection nozzle as long as a control valve blocks the flow of the fuel, which overflows from the pump work chamber via a flow conduit, to a low-pressure chamber. In this operating state, if the control valve jams and the supply of fuel to the pump work chamber is not completely prevented. A Venturi pump is provided to evacuate the fuel. By means of the Venturi pump with a permanent flow of fuel through it, the static pressure is partially dropped at a flow throttle and this negative pressure is utilized at bottom dead center (UT) of the pump piston to evacuate the pump work chamber by suction, thereby preventing an unintended injection. The apparatus is especially suitable for high-pressure injection in Diesel engines, to achieve redundantly safe operation.

6 Claims, 1 Drawing Sheet

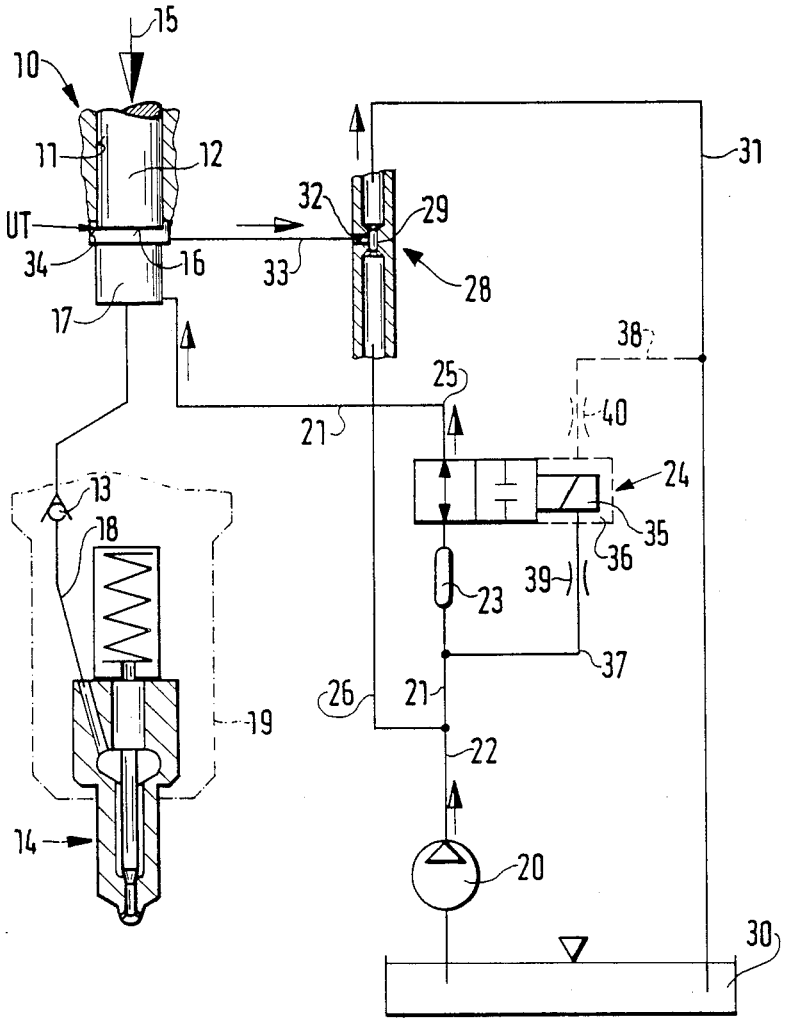
15
10
11
12
UT
34
16
17
32
29
33
28
31
38
25
40
21
24
13
18
35
36
39
23
37
26
21
19
22
14
20
30

UNIT FUEL INJECTOR INCLUDING A FUEL INJECTION PUMP FOR INTERNAL COMBUSTION ENGINES

BACKGROUND OF THE INVENTION

The invention relates to an electrically controlled unit fuel injector as defined hereinafter.

A unit fuel injector of this kind for Diesel engines, known from U.S. Pat. No. 4,669,659, is installed directly in the cylinder head of an associated engine and includes both a mechanically driven piston injection pump and an associated injection nozzle in a common housing. In this unit fuel injector, the fuel injection quantity positively displaced from the pump work chamber to the injection nozzle at the pumping pressure of the pump piston is determined by how long an electromagnetically actuated control valve that is open when it is without current is on; the control valve is located in an overflow conduit that connects the pump work chamber to a low-pressure chamber. When the control valve, in order to control the fuel injection, blocks the communication between the two segments of the overflow conduit and thus blocks the outflow of the fuel to the low-pressure chamber, the first segment of the overflow conduit, which is in continuous communication with the pump work chamber, is then subject to the full injection pressure.

In rare cases it can happen that the control valve will jam; in other words, it becomes stuck in this switching position. The possibility then exists that by reaspiration of fuel by the pump piston, fuel will continue to be delivered into the pump work chamber. This can for instance happen if a check valve that is intended to decouple the pump work chamber from the tank fails to close completely, or if a throttle in the return line stays open. If the injection event continues unintentionally in this way, there is the danger that the vehicle driven by the engine will go out of control. This must be prevented.

OBJECTS AND SUMMARY OF THE INVENTION

The unit fuel injector according to the invention as defined herein has an advantage of reliably solving the problems arising in the prior art. According to the invention, a Venturi pump, operating as a jet pump, puts the pump work chamber at negative pressure; as a result, fuel is drawn from the pump work chamber, which reliably prevents unintentional injection.

Another advantage is that when the overflow valve is closed, scavenging of the pump work chamber occurs, compelled by the suction of the Venturi pump, and thus evacuates air from the pump work chamber and keeps it free of gas bubbles. The rapid filling of the pump work chamber with fuel, due to the compulsory scavenging caused by the Venturi pump provides improved restarting of the engine after prior evacuation of the pump work chamber. The provisions recited herein define advantageous further features of the unit fuel injector set forth. For instance, with the improvements, the Venturi pump design becomes extremely simple and unlikely to malfunction; as a result, the unit fuel injector can be operated safely without any loss in function.

The characteristics set forth additionally assure cooling of the control valve without impeding the operation of the Venturi pump; there is simultaneous decoupling of the impacts of shutoff from the control valve.

The characteristics further provide damping of the motion of the control element of the control valve.

The invention will be better understood and further objects and advantages thereof will become more apparent from the ensuing detailed description of a preferred embodiment taken in conjunction with the drawing.

BRIEF DESCRIPTION OF THE DRAWING

The single FIGURE of the drawing, in a schematic view that emphasizes the flow courses, shows the most important components of an exemplary embodiment of the unit fuel injector according to the invention.

DESCRIPTION OF THE PREFERRED EMBODIMENT

The exemplary embodiment of the electrically controlled unit fuel injector of the invention, shown in the drawing, comprises a piston injection pump 10, not shown in further detail but mechanically driven in a known manner by a camshaft. Its pump housing receives a pump piston 12 driven at a constant stroke and guided in a cylinder bore 11; on its face end it has an injection nozzle 14 of a known type, and therefore not shown in further detail, secured by means of a threaded sleeve 19 shown in dot-dash lines, with a pressure valve 13 in between the pump piston and injection nozzle.

By known drive means, which are therefore indicated merely by an arrow 15, the pump piston 12 is driven via a pump tappet counter to the restoring force of a tappet spring. With its end face 16, the pump piston 12 defines a pump work chamber 17, located in the cylinder bore 11, which is sealed off from a one-way pressure valve 13 toward the injection nozzle and can be made to communicate with the injection nozzle 14 via a pressure conduit 18. However, because of the short length of the pressure conduit 18 between the pump work chamber 17 and the injection nozzle 14, this pressure valve 13 may also be omitted.

At bottom dead center UT of the pump piston 12, fuel at a low inflow pressure, for example 4 bar, is supplied to the pump work chamber 17 by a feed pump 20. Beginning at the feed pump 20, the fuel flows via a flow segment 22, embodied as part of a flow line 21 and containing a low-pressure chamber 23, to a control valve 24, which in the open position, shown, allows the fuel to flow through to the pump work chamber 17 via a further part of the flow line 21, that is, a flow conduit 25. Part of the fuel pumped by the feed pump 20 flows via a connecting segment 26, branching off from the flow segment 22, to a Venturi pump 28 having a flow throttle 29 located in the flow direction; on the downstream side, the flow throttle 29 discharges into a return line 31 leading to a tank 30. Connected to the flow throttle 29 is an intake throttle 32 of smaller cross section, preferably at a right angle, and this throttle communicates via a connecting conduit 33 with an annular groove 34 machined into the wall of the cylinder bore 11. In the bottom dead center position of the pump piston 12, shown, this groove is set back far enough that a flow of fuel out of the pump work chamber 17 via the annular groove 34 to the connecting conduit 33 can take place. The control valve 24 operating as a 2/2-way valve is a magnetic valve, the control element 35 of which controls one open position and one closing position. The control element 35 is surrounded by a scavenging chamber 36, which communicates on one end, via a scavenging line 37, with the flow segment 22 and on the other, via an outflow conduit 38, with the return line 31. The scavenging quantity flowing through the scavenging chamber 36 is limited by a metering throttle 39 introduced into the scavenging line 37 and can additionally be effected via an outflow throttle 40 located in the outflow conduit 38 and shown in dashed lines; the flow cross section of this throttle is equal to or smaller than that of the metering throttle 39. The metering throttle 39 and the outflow throttle 40 can also be replaced by means of a suitable selection of the flow cross section of the lines receiving them.

The permanent thorough scavenging of the scavenging chamber 36 dissipates the lost heat of the control element 35, and the dimensioning of the flow cross sections of the metering throttle 39, on the one hand, and of the outflow throttle 40, on the other, produces a slight backup or damming effect in the scavenging chamber 36, which leads to a damped switching behavior of the control valve. The metering throttle 39 therefore lessens the shutoff pressure surges that occur upon switchover of the control valve 24 as a result of the relief of the pump work chamber 17, which increases the safety of the control valve 24.

The arrangement described has the following course of operation: When the pump piston 12 begins its compression stroke, starting at its bottom dead center position UT, the fuel supplied to the pump work chamber 17 by the feed pump 20 is then positively displaced in the first portion of the stroke, both via the still-open annular groove 34 into the connecting conduit 33, and on via the intake throttle 32, the flow throttle 29, the flow line 31 and finally the tank 30, and also via the flow conduit 25 and the open control valve 24 to the low-pressure chamber 23, which acts as a reservoir.

After the closure of the annular groove 34 by the pump piston 12 moving farther away from its bottom dead center position, fuel continues to be positively displaced via the flow conduit 25 until such time as the control valve switches over to its closing position, in order to initiate the effective supply onset. The fuel pressure that now builds up suddenly in the pump work chamber 17 opens the pressure valve 13, and the fuel is pumped via the pressure conduit 18 to the injection nozzle 14. From there, it reaches the combustion chamber of the engine in a known manner.

To terminate the pumping of fuel to the engine combustion chamber, the flow of current to the control element 35 of the control valve 24 is switched off, as a function of the operating data ascertained in an electronic control unit. At this time, the control valve 24 is switched into its open position, shown. As a result, the pump work chamber 17 is relieved toward the low-pressure chamber 23, and the pressure in the pump work chamber 17 drops abruptly. Thus, the pressure valve 13 and the injection nozzle 14 close, and so the injection is terminated.

Regardless of the switching position of the control valve 24, as long as the feed pump 20 is driven, fuel flows continuously via the flow segment 22 and the connecting segment 26 from the feed pump 20 via the Venturi pump 28 and the return line 31 to the tank 30. Because of the partial increase in speed via the cross-sectional restriction in the flow throttle 29, the static pressure drops here; this generates suction in the connecting conduit 33. When the pump piston 12 is in the vicinity of its bottom dead center position, and the annular groove 34 is opened, in terms of its communication with the pump work chamber 17, this causes a flow of fuel as indicated by the parallel arrows from the feed pump 20, via the flow segment 22 having the low-pressure chamber 23, the open control valve 24, and the flow conduit 25 to the pump work chamber 17 and via the annular groove 34 and the connecting conduit 33 to the Venturi pump 28, and from there via the return line 31 to the tank 30. The quantity of this fuel flow depends on the intensity of the suction generated by the flow throttle 29 via the propellant flow and is also jointly influenced by the flow cross section of the intake throttle 32. The flow cross sections of the flow throttle 29 and intake throttle 32 are adapted to one another such that rapid filling of the pump work chamber 17 with fuel and subsequent scavenging of the pump work chamber 17 for cooling it and removing air and vapor bubbles occur when the pump piston 12 is receding in the direction of bottom dead center, even if the annular groove 34 is simultaneously open.

This process is interrupted, if the pump piston 12 at the beginning of its compression stroke covers the annular groove 34 until that groove 34 is opened again by the pump piston.

If the control valve 24 were to move into its closing position and block its control element 35 in that position, then if there were no Venturi nozzle 28 the pump piston 12 would be capable of undesirably continuing the injection with the fuel available to it, for example via leakage flow allowed by tolerances of the various components, or because of defective components or as a result of the volume of lines or filters, including the return line 31 and the connecting conduit 33. In this malfunction situation, with the annular groove 34 opened, fuel is aspirated from the pump work chamber 17 by the suction of the Venturi pump 28, and a negative pressure that prevents uncontrolled injection is generated. From this,, it is clear that it is advantageous to position the annular groove 34 in the vicinity of bottom dead center UT; as a result, near its point of reversal, the pump piston 12 can develop virtually no further suction and thus cannot exert any dominance over the suction of the Venturi pump 28. Even with the annular groove 34 closed, the fuel flowing continuously through the flow throttle 29 generates such a marked negative pressure in the connecting conduit 33 containing the intake throttle 32 that if the control valve 24 remains struck in the closed position, the negative pressure established in the pump work chamber 17 in the intake stroke of the pump piston 12 is always less than that in the connecting conduit 33. This reliably prevents reaspiration of fuel out of the return line 31.

The foregoing relates to a preferred exemplary embodiment of the invention, it being understood that other variants and embodiments thereof are possible within the spirit and scope of the invention, the latter being defined by the appended claims.

What is claimed and desired to be secured by Letters Patent of the United States is:

1. An electrically controlled fuel injection pump (10) for internal combustion engines, in particular a unit fuel injector for fuel injection in Diesel engines, having at least one pump piston (12), driven at a constant stroke, which defines a pump work chamber (17) and in a supply stroke pumps the fuel, supplied to this pump work chamber (17) at inflow pressure by a feed pump (20), to an injection nozzle (14) at injection pressure; having an electrically actuatable control valve (24), which is inserted between a flow segment (22) containing a low-pressure chamber (23) and a flow conduit (25), said control valve (24) communicating continuously with the pump work chamber (17), of a flow line (21), and by means of which an otherwise open communication for filling of the pump work chamber (17) between the flow segment (22) and the flow conduit (25) is blockable in order to control the duration of fuel injection; a connecting conduit (33), connected to the pump work chamber (17) and opened by the pump piston 12 only in a bottom dead center position (UT) of said pump piston, the connecting conduit being located and connected between the pump work chamber (17) and a return line (31) which carries excess fuel back to the tank (30), a venturi pump (28), said connecting conduit (33) and said return line (31) communicate via said venturi pump (28) which acts as a jet pump, said venturi pump connected on its inflow side, via a connecting segment (26), which connects to the flow segment (22) of the flow line (21), and on its outflow side to the return line (31), and connected on the intake side to the pump work chamber (17), via the connecting conduit (33).

2. A fuel injection pump (10) as defined by claim 1, in which said Venturi pump (28) is embodied by a flow throttle (29) and an intake throttle (32) that discharges preferably at right angles into the flow throttle (29), wherein the flow throttle (29) connects the connecting segment (26) to the return line (31), and the intake throttle (32) connects the pump work chamber (17) to the flow throttle (29).

3. A fuel injection pump (10) as defined by claim 1, which includes a scavenging chamber (36) that surrounds one end of the control valve (24) in a vicinity of a control element (35), said scavenging chamber being connected via a scavenging line (37) to the flow segment (22) of the flow line (21), a metering throttle (39) is inserted into the scavenging line (37), said metering throttle (39) limits an inflow to the scavenging chamber (36) and the flow cross section of the metering throttle is smaller than that of said flow throttle (29) of the Venturi pump (28), and said scavenging chamber (36) communicates with the return line (31) via an outflow conduit (38).

4. A fuel injection pump (10) as defined by claim 2, which includes a scavenging chamber (36) that surrounds one end of the control valve (24) in a vicinity of a control element (35), said scavenging chamber being connected via a scavenging line (37) to the flow segment (22) of the flow line (21), a metering throttle (39) is inserted into the scavenging line (37), said metering throttle (39) limits an inflow to the scavenging chamber (36) and the flow cross section of the metering throttle is smaller than that of said flow throttle (29) of the Venturi pump (28), and said scavenging chamber (36) communicates with the return line (31) via an outflow conduit (38).

5. A fuel injection pump (10) as defined by claim 3, in which an outflow throttle (40) is inserted into the outflow conduit (38), from the scavenging chamber and the flow cross section of the outflow throttle (40) is adapted in such a way to the flow cross section of the metering throttle (39) that a backup pressure is created in the scavenging chamber (36).

6. A fuel injection pump (10) as defined by claim 4, in which an outflow throttle (40) in inserted into the outflow conduit (38), from the scavenging chamber and the flow cross section of the outflow throttle (40) is adapted in such a way to the flow cross section of the metering throttle (39) that a backup pressure is created in the scavenging chamber (36).

* * * * *